United States Patent [19]

Chabanov et al.

[11] 4,255,954

[45] Mar. 17, 1981

[54] DEVICE FOR CONTROLLING SHAPE OF STRIP OR SHEET BEING ROLLED

[76] Inventors: Alim I. Chabanov, ulitsa Uritskogo, 12, kv. 73; Valery V. Daniljuk, ulitsa Revoljutsii, 6, kv. 46, both of Novosibirsk; Vladimir I. Rusaev, prospekt Oktyabrskoi Revolutsii, 93, kv. 52, Sevastopol; Sergei N. Tropin, ulitsa Udarnayaa, 1/2, kv. 52, Novosibirsk; Petr S. Grinchuk, ulitsa 19 Partsiezda, 65, kv. 9, Kramatorsk; Viktor I. Ponomarev, ulitsa Marata, 12, kv. 63, Kramatorsk; Georgy G. Fomin, ulitsa Katirinicha, 3, kv. 22, Kramatorsk; Miro; Ivan K. Shnikov, ulitsa Pobedy, 12, kv. 57, Lipetsk; Ivan N. Bogaenko, ulitsa Sholom Aleikhema, 27, kv. 90; Vladimir M. Pisarenko, ulitsa Demyana Bednogo, 25a, kv. 14, both of Kiev, all of U.S.S.R.

[21] Appl. No.: 62,221

[22] Filed: Jul. 30, 1979

[51] Int. Cl.[3] ..... B21B 37/00

[52] U.S. Cl. ..... 72/19; 72/21; 72/205

[58] Field of Search ..... 72/6, 12, 19, 21, 205

[56] References Cited

U.S. PATENT DOCUMENTS

| | | | |
|---|---|---|---|
| 3,459,019 | 8/1969 | Stone | 72/12 |
| 3,782,152 | 1/1974 | Sabatim | 72/9 |
| 4,033,165 | 7/1977 | Arlmura et al. | 72/205 |

*Primary Examiner*—Milton S. Mehr

*Attorney, Agent, or Firm*—Steinberg & Raskin

[57] ABSTRACT

A device for controlling the shape of the strip or sheet being rolled comprises at least two sets of rollers positioned in pairs on both sides of the strip or sheet across the width thereof and incorporating speed actuators for tensioning said strip of sheet, a reglator means for regulating the tension of the rolled strip or sheet, having its inputs electrically connected to the actuators from which output signals representative of a predetermined initial virtual tension of the strip or sheet being rolled are applied thereto, a means for setting a predetermined tensioning of the strip or sheet being rolled, said tension setting means being connected to the other input of the strip or sheet tension regulating means having its output electrically connected to the control inputs of the actuators, sensor means for sensing angular position of the rollers, and a comparator having its inputs connected to the outputs of the sensor means for sensing the angular position of the rollers and its output to other control inputs of the actuators.

2 Claims, 3 Drawing Figures

DEVICE FOR CONTROLLING SHAPE OF STRIP OR SHEET BEING ROLLED

BACKGROUND OF THE INVENTION

I. Field of the Invention

The present invention relates to a system for controlling the shape of strips or sheets.

The invention is readily applicable for use at mills for cold or hot rolling of strips or sheets where automatic control or regulation of their shape is effected.

The strip or sheet being rolled tends to have irregularities in its shape, such as edge buckles or crowns, caused by the ever-changing rolling conditions (a roll force, overdue tensioning, rate of rolling, displacement of the housing screw, alterations in thickness or cross section of the strip or sheet being fed, a distribution of temperature lengthwise of the roll body). In order to avoid the irregularities in the shape of the rolled strip or sheet, it has been employed in the art automatic control systems the application of which presents some difficulty in carrying out effective control of the shape of the strip or sheet being rolled.

For example. U.K. Pat. No. 1,290,096 describes a device for controlling the shape of a strip or sheet being rolled, which comprises reference means or a light source spaced from the strip or sheet which is being rolled and disposed at a right angle relative to the longitudinal direction thereof, a TV camera for viewing or quantitatively detecting a virtual image of said reference means formed by the reflection upon the reflecting surface of the said strip or sheet, detecting means for detecting the deviation of the virtual image representative of the middle and end portions of the strip or sheet being rolled from a predetermined reference, and hydraulic pressure means for correcting the roll camber of a pair of working rolls in response to the output from said detecting means.

To enable effective operation of the above-described device, it is necessary to remove water (emulsion) and oil from the surface of the rolled strip or sheet, which, if unremoved, cause the light beams falling on the strip or sheet to refract, thus permitting error or distortions to occur in the measurement of the strip or sheet shape. In addition, aggressive ambient atmosphere of rolling mills impairs operating efficiency of the optical and TV instruments employed in the device.

There is also known a device for controlling the shape of a strip or sheet being rolled (see "Shape Measurement and Control", by W. K. Y. Pearson, B.Sc. Journal of the Institute of Metals, 1964–65, vol. 93, p. 169–178), comprising rollers positioned transversely on both sides of the strip or sheet and brought in contact therewith at the exit from a roll mill stand, with the shape of the rolled strip or sheet being controlled in accordance with alterations in the rotational speed of said rollers. Operatively connected with the rollers are selsyns which form the output signal in response to the disagreement in the rotational speed of the rollers. There are also provided means for detecting the travelling speed of the strip or sheet, a means for correcting the shape of the strip or sheet being rolled, a means for detecting irregularities in the shape of the strip or sheet being rolled, a computer having its inputs connected to the selsyns and to the means for detecting the travelling speed of the rolled strip or sheet and its output connected to the means for correcting the shape of the rolled strip or sheet and to the strip or sheet shape indicator.

However, the device described above is disadvantageous in that the strip shape output signal is formed with a substantial time lag (up to 1 sec), since the time of operation of the strip-shape controller and the strip travelling-speed sensor, built around selsyns, servomotors and tachogenerators, is not rapid enough to embrace the entire operating range of deviations in the shape of a strip or sheet being rolled.

SUMMARY OF THE INVENTION

It is an object of the invention to provide a device for controlling the shape of a strip or sheet being rolled, wherein the time of operation required for controlling the shape of the rolled strip or sheet is increased by an order of magnitude, thereby permitting the sheet stock produced to be improved in quality.

Another object of the invention is to enhance operating reliability of such device.

Still another object of the invention is to simplify the strip or sheet wave-shape circuit.

These and other objects and features of the invention are accomplished by the provision of a device for controlling the shape of a strip or sheet being rolled, comprising rollers positioned across the width of the strip or sheet and brought in contact therewith at the exit from a roll housing, the strip- or sheet-shape correcting operation being effected in accordance with the disagreement in the speed of rotation of said rollers, wherein, according to the invention, the rollers are arranged in pairs on both sides of the strip or sheet being rolled and are combined in at least two sets each being provided with a speed actuator for tensioning the strip or sheet, and wherein there are also provided a means for regulating the tensioning of the strip or sheet, having its inputs electrically connected to the actuators from which output signals representative of a predetermined initial tension of the strip or sheet are applied thereto, a means for setting a predetermined tension of the strip or sheet, said tension setting means being connected to another input of the strip or sheet tension regulating means having its output electrically connected to control outputs of the actuators, a means for sensing angular positions of the rollers, and a comparator having its inputs connected to the outputs of the means for sensing angular positions of the rollers and its output connected to other control inputs of the actuators.

In order to expand the operating range of the device according to the invention for controlling the shape of the strip or sheet being rolled, the inputs of a hydraulic pressure means provided therein for regulating the roll camber of workrolls are preferably electrically connected to the roller actuators.

With the device of the invention it becomes possible to step up at least by an order of magnitude of time of operation required for correcting the shape of the rolled strip or sheet in response to a change in the mutual angular disposion of the rollers, and wherein the shape measuring action is effected practically instantaneously. The provision of two steps in the shape control operation (redistribution of the strip tension across its width and roll cambering by hydraulic means) makes it possible to embrace the entire range of deviations due to occur in the shape of the strip or sheet being rolled.

It also has become possible to provide in the device of the invention a system of pull-out rollers wherein a resultant torque is automatically redistributed between each set of rollers in accordance with the tension distributed transversely of the roll strip or sheet.

Where side camber appears on the strip or sheet being rolled, the tensioning is increased in the middle portion thereof due to an increase of the pulling force of the power-actuated rollers in contact with the middle portion of the strip or sheet, whereas the tensioning at the side edges of said strip or sheet is decreased with the pulling force of the power-actuated rollers in contact with the side edges of the rolled strip or sheet. Thus the travel speed of metal at various places across the width of the strip or sheet being rolled is equalized.

If, however, the rolled strip or sheet develops crowning, the tension is increased at the side edges of said strip or sheet with the pulling force of the power-actuated rollers in contact with the side edges of the strip or sheet, while the tensioning of the strip or sheet at the middle portion thereof decreases with the pulling force of the power-actuated rollers in contact with the middle portion of said strip or sheet. Consequently, rollers and their actuators function as a servomechanism in the automatic shape control device, or they can be adapted to control the hydraulic means for correcting the roll camber of a pair of working rolls. The governing factor here is a preset ratio between the currents in the armature circuits of actuators. Any change in this ratio will result in the formation of control command effecting the bending force applied to the backup rolls supporting working rolls.

BRIEF DESCRIPTION OF THE DRAWINGS

The invention will be further described, by way of example only, with reference to the accompanying drawings, wherein.

DETAILED DESCRIPTION OF THE PREFERRED EMBODIMENT

Figure 1:
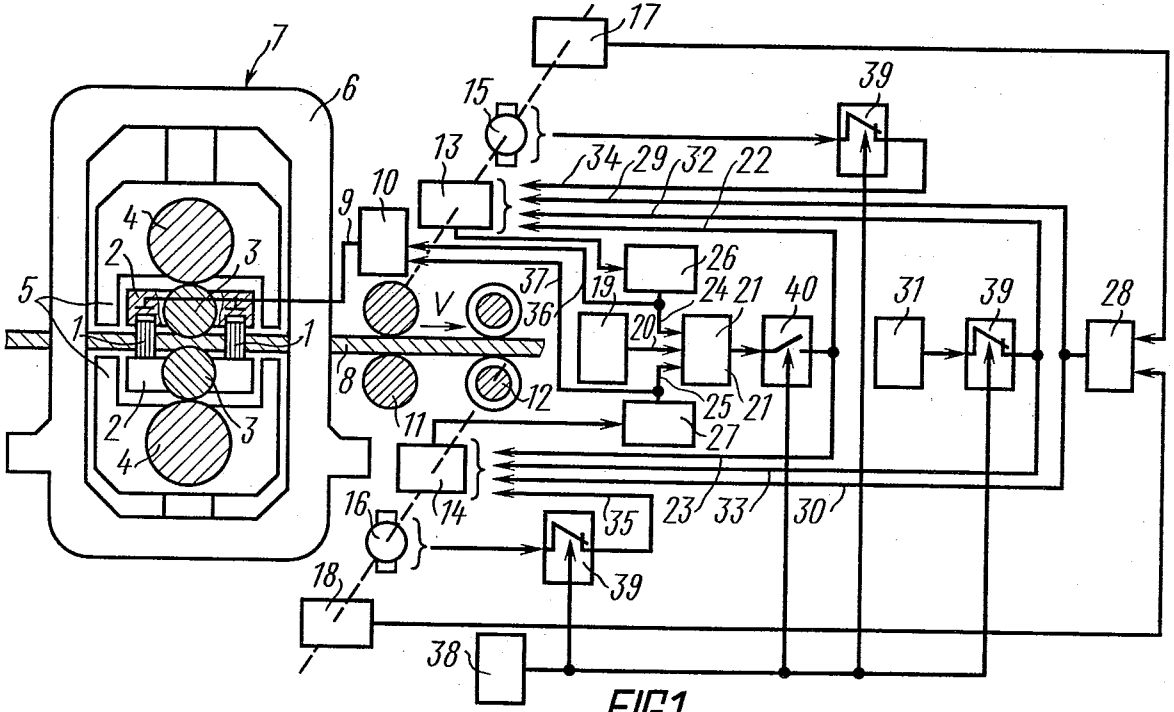
FIG. 1 is a block diagram of a device for controlling the shape of a strip or sheet being rolled.

The device according to the invention for controlling the shape of a strip or sheet being rolled comprises hydraulic cylinders 1 (FIG. 1) interposed between supports 2 of working rolls 3 mounted intermediate backup rolls 4 in support stands 5 positioned in a roll housing 6 of a mill stand 7 wherein a strip or sheet 8 is being rolled at a preset speed V. The hydraulic cylinders 1 are connected through a pipeline 9 with a hydraulic means 10 for controlling the roll camber of the working rolls 3. A delivery table (not shown) has two sets of rollers 11, 12 arranged in pairs at the exit from the mill stand 7 on both sides of the strip or sheet 8. Each set of rollers, 11, 12 is respectively provided with an actuator 13 and 14 intended for tensioning the strip or sheet 8. The rollers 11 are brought in contact with the strip or sheet 8 in the middle portion thereof, and the rollers 12 come in contact with the strip or sheet 8 at the side edges thereof.

The actuators 13, 14 have their shafts geared respectively to tachogenerators 15, 16 and to sensor means 17, 18 for sensing angular positions of the rollers 11, 12. The resultant tensioning of the strip or sheet 8 by means of the rollers 11, 12 is preset with the aid of a suitable tension setting means 19 having its output connected to an output 20 of a tension control means 21 whose output is electrically connected to control inputs 22, 23 of the actuators 13, 14. The tension control means 21 has its other inputs 24, 25 connected to the outputs of sensor means 26, 27 for sensing a virtual tension of the strip or sheet 8 effected by the actuators 13, 14. The tension sensor means 26, 27 are provided of any conventional type, for example, in the form of sensor means for sensing the current in the armature of an electric motor. The sensor means 17, 18 for sensing angular positions of the rollers 11, 12 are connected to a comparator 28 forming a synchrosignal representative of mutual angular disposition of the rollers 11, 12, the output of said comparator being connected to control inputs 29, 30 of the actuators 13, 14.

The rotating speed of the rollers is preset by means of a speed selector 31 the output of which is electrically connected to control inputs 32, 33 of the actuators 13, 14. With regard to the speed of rotation of the rollers 11, 12, there is provided a velocity feedback connecting the tacho-generators 15, 16 to control inputs 34, 35 of the actuators 13, 14. Control inputs 36, 37 of the hydraulic means 10 for controlling the roll camber of the workrolls 3 are connected to the outputs of the sensors means 26, 27 for sensing the tensioning of the strip or sheet 8 in order to vary the bending force of the workrolls 3 in accordance with the change in the tensioning of the strip or sheet 8. The hydraulic controller means 10 is provided of any conventional type, for example, in the form of a valve-controlled actuator.

There is also provided a sensor means 38 for sensing the presence of metal in the rollers 11, 12, of any conventional type based, for example, on photorelay, connected to the control inputs of switching means 39, 40 (for example, contact and contactless switching means), a roller rotating speed feedback switching circuit, a roller rotating speed setting circuit, and an output circuit of the tension controller 21.

Figure 2:
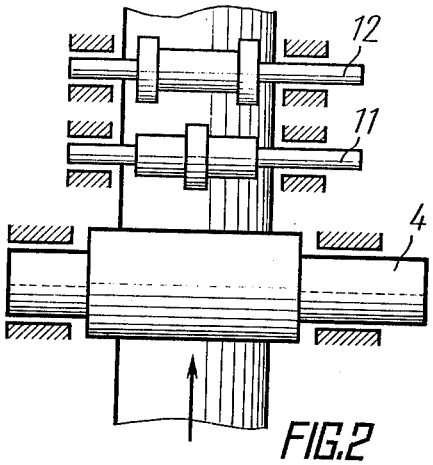
FIGS. 2, 3 shows various dispositions of the sets of rollers transversely of the strip or sheet being rolled.

FIG. 2 shows the disposition of the rollers 11, 12 transversely of the strip or sheet 8 being rolled. A set of rollers 11 comprises one pair of rollers and is brought in contact with the middle portion of the rolled strip or sheet 8. The other set of rollers 12 comprises two pairs of rollers each being brought in contact with the side edges of the strip or sheet 8 being rolled.

Figure 3:
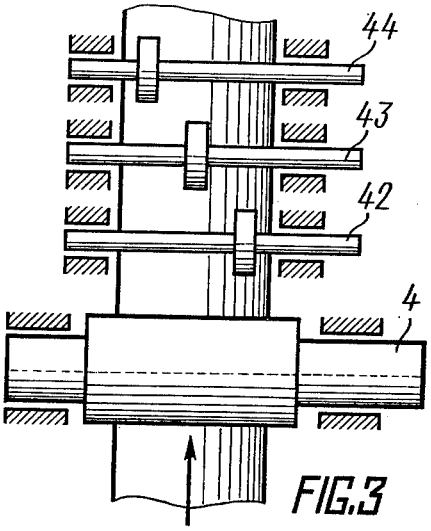

FIG. 3 shows three sets of rollers 42, 43, 44, each set comprising a pair of rollers brought in contact with the strip or sheet 8 only at one of its sections across the width thereof.

It has been found that the quality of measurement and control of the shape of the rolled strip or sheet improves with an increase in the number of sets of rollers.

The device according to the invention for controlling the shape of a strip or sheet being rolled functions in the following manner.

As a rolling mill is set for operation, a signal representative of a predetermined speed of rotation of the rollers 11, 12 is applied from the speed selector 31 to the inputs 32, 33 (FIG. 1) of the actuators 13, 14 through the intermediary of the switching means 39. There is also a signal representative of the resultant tensioning of the strip or sheet 8, formed by the tension setting means 19, that is indicative of the total force applied through the rollers 11, 12 to the strip or sheet 8 being rolled. On achieving a desired acceleration of the actuators 13, 14, the angular spatial arrangement of the rollers 11, 12 is synchronized in response to the signal from the comparator 28.

As soon as the rollers 11, 12 engage the strip or sheet 8 on command from the sensor means 38, the switching means 39 operates to brake the roller rotating speed feedback circuit and the roller speed setting circuit, and the switching means 40 operates to make the output circuit of the strip tension controller 21.

If the mutual angular arrangement of the rollers 11, 12 remains unaltered, the strip or sheet 8 being rolled will be subject to uniform tensioning throughout the width thereof. In the event of deformations due to appear under the everchanging rolling conditions at various sections of the rolled strip or sheet 8 issuing from the mill stand 7, the distribution of the tensioning force transversely of the rolled strip or sheet 8 and, consequently, of the loads applied to the actuators 13, 14 of the rollers 11, 12, will deviate from their predetermined values. Thus an increase in the crowning of the workrolls 3 due to a rise in temperature will result in lower tensioning in the middle portion of the strip or sheet 8 and, consequently, in lower load acting on the rollers 11.

As a result, the rotating speed of the rollers 11 is increased. As this happens, the disagreement between the speeds of rotation of the rollers 11 and 12 becomes more pronounced, so that the comparator 28 operates to send a slow-down signal to the actuator 13 and a step-up signal to the actuator 14. Along with this, the load on the actuator 14 is increased, and that on the actuator 13 is decreased. This, in turn, results in higher tensioning of the strip or sheet 8 provided by the rollers 12 (grooved in the middle) at the side edges thereof, and in lower tensioning of the strip or sheet 8 enabled by the rollers 11 (grooved at the side edges) at the middle portion thereof. Consequently, the travel speed of metal at the exit from the mill stand 7 at various sections transversely of the strip or sheet 8 is equalized, thereby correcting the shape of the strip or sheet 8. If, however, the travel speed of the issuing metal at the side edges of the strip or sheet 8 is increased, the comparator 28 operates to signal an increase in the tensioning force created by the rollers 11 and a decrease in the tensioning created by the rollers 12. Thus the shape of the strip or sheet 8 being rolled is controlled or corrected by virtue of automatic redistribution of the tension force transversely of the strip or sheet 8 at the delivery table of a rolling mill.

The hydraulic means 10 for controlling the roll camber of the workrolls 3, expanding the operating range of the automatic strip or sheet-shape control system, operates in response to the difference in the extent of tensioning of the rollers 11, 12 whose signals are formed by the sensor means 26, 27 for sensing the strip or sheet tension created by the rollers 11, 12 in response to the signals from the actuators 13, 14. The temperature control system of the roll camber of the workrolls can be effected in a similar manner.

After the rolled strip or sheet 8 has emerged from the rollers 11, 12, the output circuit of the strip tension controller 21 is broken by the switch 40, whereby the speed of rotation of the rollers 11, 12 is stabilized. The engagement of the successive strip or sheet 8 can be possibly effected with or without storing information on the preceding distribution of tensioning between the rollers 11, 12.

The device of the invention makes it possible to control the shape of the rolled strip or sheet 8 with a high degree of accuracy, thereby substantially improving the quality of the rolled sheet stock.

There is no need in reequipment of the rolling mill due to the introduction of the automatic control system into the production line thereof.

What is claimed is:

1. A device for controlling the shape of a strip or sheet being rolled at the exit from a mill stand, comprising:

at least two sets of rollers arranged in pairs at both sides of said strip and transversely thereof at the exit from said mill stand and brought in contact with preselected zones of said strip or sheet so as to correct the shape thereof in accordance with the difference in the rotational speed of said rollers and consequent difference in tension at said zones;

speed actuators for each set of said rollers, said speed actuators being geared respectively to each set of rollers intended for tensioning said strip or sheet and having control inputs;

a means for regulating the tension of said strip or sheet, having inputs and outputs, said tension regulating means having one group of said inputs connected to said speed actuators from which electric signals representative of a predetermined initial tension of the strip or sheet are applied thereto, said output of said tension regulating means being electrically connected to control inputs of said speed actuators;

a means for setting the tension of said strip or sheet, said means having an output electrically connected to an input of said tension regulating means;

a comparator having inputs and an output, said comparator being connected to said control inputs of said speed actuators;

sensor means for sensing angular positions of said of said rollers, one for each set of rollers, said sensor means having outputs connected to said inputs of said comparator.

2. A device for controlling the shape of a strip or sheet being rolled as claimed in claim 1, comprising: a hydraulic means for controlling a roll camber of the workrolls mounted in said mill stand, said hydraulic means having its inputs electrically connected to said speed actuators; said inputs having electric signals representative of the virtual tensioning of the strip or sheet applied thereto.

* * * * *